US010174622B2

(12) United States Patent
Zhang et al.

(10) Patent No.: US 10,174,622 B2
(45) Date of Patent: Jan. 8, 2019

(54) WRAPPED SERPENTINE PASSAGES FOR TURBINE BLADE COOLING

(71) Applicant: Solar Turbines Incorporated, San Diego, CA (US)

(72) Inventors: Luzeng Zhang, San Diego, CA (US); Juan Yin, San Diego, CA (US); Hee Koo Moon, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 457 days.

(21) Appl. No.: 15/096,866

(22) Filed: Apr. 12, 2016

(65) Prior Publication Data

US 2017/0292386 A1 Oct. 12, 2017

(51) Int. Cl.
*F01D 5/18* (2006.01)
*F01D 5/20* (2006.01)

(52) U.S. Cl.
CPC ..... *F01D 5/187* (2013.01); *F01D 5/20* (2013.01); *F05D 2250/185* (2013.01); *F05D 2260/22141* (2013.01)

(58) Field of Classification Search
CPC . F01D 5/18; F01D 5/182; F01D 5/186; F01D 5/187; F01D 5/188; F01D 5/20; F05D 2250/185; F05D 2260/20; F05D 2260/201; F05D 2260/202; F05D 2260/204; F05D 2260/205
See application file for complete search history.

(56) References Cited

U.S. PATENT DOCUMENTS

| | | | | |
|---|---|---|---|---|
| 5,395,212 | A | 3/1995 | Anzai et al. | |
| 5,591,007 | A | 1/1997 | Lee et al. | |
| 5,669,759 | A * | 9/1997 | Beabout | F01D 5/187 416/97 R |
| 6,220,817 | B1 * | 4/2001 | Durgin | F01D 5/187 415/115 |
| 7,645,122 | B1 * | 1/2010 | Liang | F01D 5/187 416/97 R |
| 7,901,183 | B1 | 3/2011 | Liang | |
| 7,988,419 | B1 * | 8/2011 | Liang | F01D 5/187 416/96 R |
| 8,087,892 | B1 | 1/2012 | Liang | |

(Continued)

*Primary Examiner* — Logan Kraft
*Assistant Examiner* — Jason Davis
(74) *Attorney, Agent, or Firm* — Finnegan, Henderson, Farabow, Garrett & Dunner, LLP

(57) ABSTRACT

A turbine blade for a gas turbine engine may include at least two wrapped, serpentine-shaped internal cooling paths. A first one of the serpentine-shaped internal cooling paths may include a first passage that extends radially along a leading edge of the turbine blade from adjacent a root end of the turbine blade to adjacent a tip end of the turbine blade. The first passage may be configured to provide fresh cooling fluid to the leading edge. A second passage downstream of the first passage may be configured to discharge spent cooling fluid from the first passage of the first one of the serpentine-shaped internal cooling paths across a plurality of flow disrupters positioned along an upper span of a trailing edge of the turbine blade before exiting from the trailing edge of the turbine blade. A second one of the serpentine-shaped internal cooling paths may be configured to supply fresh cooling fluid to a lower span of the trailing edge of the turbine blade.

20 Claims, 4 Drawing Sheets

(56) References Cited

U.S. PATENT DOCUMENTS

| | | | | |
|---|---|---|---|---|
| 8,118,553 | B2 * | 2/2012 | Liang | F01D 5/187 415/115 |
| 8,192,146 | B2 | 6/2012 | Liang | |
| 8,267,658 | B1 * | 9/2012 | Liang | F01D 5/187 416/97 R |
| 8,459,934 | B2 * | 6/2013 | Hofmann | F01D 5/147 415/115 |
| 8,628,298 | B1 * | 1/2014 | Liang | F01D 5/187 416/96 R |
| 8,920,122 | B2 * | 12/2014 | Lee | F01D 5/182 416/97 R |
| 9,194,237 | B2 | 11/2015 | Dillard et al. | |
| 9,314,838 | B2 * | 4/2016 | Pointon | B22C 7/02 |
| 9,447,692 | B1 * | 9/2016 | Liang | F01D 5/187 |

* cited by examiner

WRAPPED SERPENTINE PASSAGES FOR TURBINE BLADE COOLING

TECHNICAL FIELD

The present disclosure relates generally to turbine blade cooling, and more particularly to wrapped serpentine passages for turbine blade cooling.

BACKGROUND

Gas turbine engines (GTEs) produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. In a typical turbine engine, one or more fuel injectors direct a liquid or gaseous hydrocarbon fuel into the combustor for combustion. The resulting hot gases are directed over blades of the turbine to spin the turbine and produce mechanical power. The engine efficiency can be increased by passing a higher temperature gas into the turbine. However, material properties and cooling limitations limit the turbine inlet temperature.

High performance GTEs include cooling passages and cooling fluid to improve reliability and cycle life of individual components within the GTE. For example, in cooling the turbine section, cooling passages are provided within the turbine blades to direct a cooling fluid therethrough. Conventionally, a portion of the compressed air is bled from the air compressor to cool components such as the turbine blades. The amount of air bled from the air compressor, however, is limited so that a sufficient amount of compressed air is available for engine combustion to perform useful work.

U.S. Pat. No. 8,087,892 to Liang (the '892 patent) describes a turbine blade with a dual serpentine flow cooling circuit. According to the '892 patent, a 5-pass serpentine circuit is located along the leading edge and the tip section of the blade, and a 3-pass serpentine circuit is formed within the 5-pass serpentine circuit with a third leg located along the trailing edge of the blade. In the '892 patent the third leg must provide cooling fluid along the entire trailing edge of the blade, and therefore some of the cooling potential of the cooling fluid passing through the 3-pass serpentine circuit is used for cooling the upper span of the trailing edge, while the hotter, lower span of the trailing edge may be penalized. The turbine blade cooling system of the '892 patent may therefore not provide the most efficient and effective distribution of cooling fluid to the hottest portions of the turbine blade.

The present disclosure is directed to overcoming one or more of the shortcomings set forth above.

SUMMARY

In one aspect, a turbine blade for a gas turbine engine is disclosed. The turbine blade may include at least two wrapped, serpentine-shaped internal cooling paths. A first one of the serpentine-shaped internal cooling paths may include a first passage that extends radially along a leading edge of the turbine blade from adjacent a root end of the turbine blade to adjacent a tip end of the turbine blade. The first passage may be configured to provide fresh cooling fluid to the leading edge. A second passage downstream of the first passage may be configured to discharge spent cooling fluid from the first passage of the first one of the serpentine-shaped internal cooling paths across a plurality of flow disrupters positioned along an upper span of a trailing edge of the turbine blade. A second one of the serpentine-shaped internal cooling paths may be configured to supply fresh cooling fluid to a lower span of the trailing edge of the turbine blade.

In yet another aspect, a method of cooling a turbine blade for a gas turbine engine is disclosed. The turbine blade may include at least two wrapped serpentine-shaped internal cooling paths defined at least in part between internal walls that extend between a pressure side and a suction side of the blade. The pressure side and suction side of the blade are interposed between a leading edge and a trailing edge of the blade and between a root end and a tip end of the blade. The method may include supplying fresh cooling fluid through a first passage of a first one of the cooling paths, wherein the first passage extends radially from the root end to the tip end adjacent the leading edge of the blade. The method may further include directing spent cooling fluid from the first passage adjacent the leading edge to one of an upper span of the trailing edge of the blade or a mid-chord passage and the upper span of the trailing edge of the blade. The method may still further include supplying fresh cooling fluid through a second one of the cooling paths to one of a lower span of the trailing edge of the blade or a mid-chord passage and the lower span of the trailing edge.

In another aspect, a turbine blade for a gas turbine engine is disclosed. The turbine blade may include at least two wrapped, serpentine internal cooling paths, wherein a first one of the serpentine internal cooling paths includes a first passage that extends radially along a leading edge of the turbine blade and provides fresh cooling fluid to the leading edge, and a second passage downstream of the first passage that discharges spent cooling fluid from the first passage of the first one of the serpentine internal cooling paths across a plurality of pins and fins positioned along an upper span of a trailing edge of the turbine blade. A second one of the serpentine internal cooling paths supplies fresh cooling fluid to a mid-chord passage through the turbine blade, the mid-chord passage being at least partially overlapped on a leading edge side and on a trailing edge side by the first passage and the second passage, respectively, of the first one of the serpentine internal cooling paths. The second one of the serpentine internal cooling paths may be configured to supply cooling fluid that has flowed through the mid-chord passage of the turbine blade to a lower span of the trailing edge of the turbine blade.

DETAILED DESCRIPTION

Figure 1:
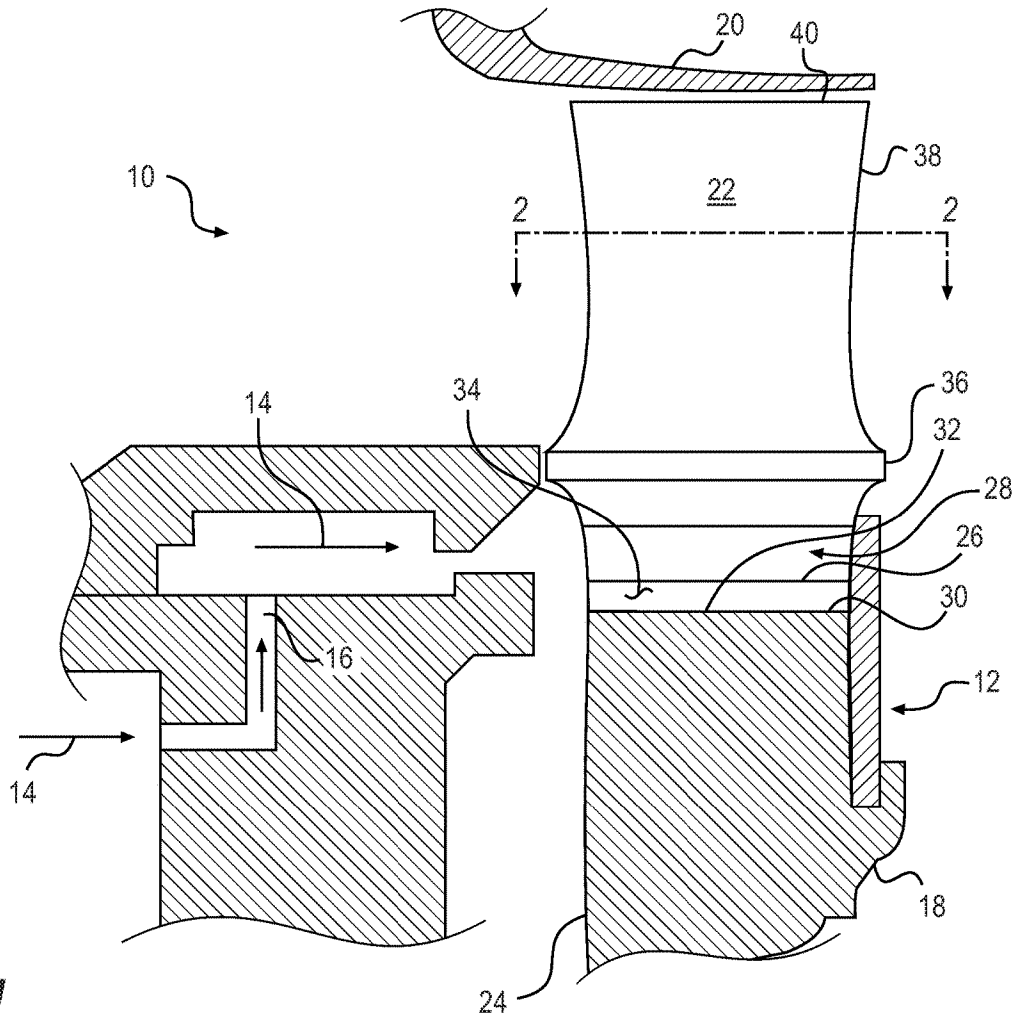
FIG. 1 is a sectional view of a portion of a turbine section of a gas turbine engine.

FIG. 1 illustrates a sectional view of a portion of a GTE, specifically a turbine section 10 of the GTE. The turbine section 10 includes a first stage turbine assembly 12 disposed partially within a first stage shroud assembly 20.

During operation, a cooling fluid, designated by the arrows 14, flows from the compressor section (not shown) to the turbine section 10. Furthermore, each of the combustion chambers (not shown) are radially disposed in a spaced apart relationship with respect to each other, and have a space through which the cooling fluid 14 flows to the turbine section 10. The turbine section 10 further includes a support structure having a fluid flow channel 16 through which the cooling fluid 14 flows.

The first stage turbine assembly 12 includes a rotor assembly 18 radially aligned with the shroud assembly 20. The rotor assembly 18 may be of a conventional design including a plurality of turbine blades 22. The turbine blades 22 may be made from any appropriate materials, for example metals or ceramics. The rotor assembly 18 further includes a disc 24 having a plurality of circumferentially arranged root retention slots 30. The plurality of turbine blades 22 may be replaceably mounted within the disc 24. Each of the plurality of blades 22 may include a first, or root end 26 having a root section 28 extending therefrom which engages with one of the corresponding root retention slots 30. The first end 26 may be spaced away from a bottom 32 of the root retention slot 30 in the rotor assembly 18 to form a cooling fluid inlet opening 34 configured to receive cooling fluid 14. Each turbine blade 22 may further include a platform section 36 disposed radially upward from a periphery of the disc 24 and the root section 28. Additionally, an airfoil 38 may extend radially upwardly from the platform section 36. Each of the plurality of turbine blades 22 may include a second, tip end 40, positioned opposite the first, root end 26 and adjacent the shroud 20. Throughout this specification reference may be made to portions of a turbine blade that are disposed "radially upward" when referring to portions that are closer to the tip end of the blade than the root end of the blade. Similarly, "radially downward" may refer to portions that are closer to the root end of the blade than the tip end. One of ordinary skill in the art will recognize that the use of these relative positional terms is for purposes of description only, and that the root end of a turbine blade is clearly not always in a position that is "below" the tip end when viewed in a universal frame of reference. The description "radially upward" or "radially upwardly" may also be described as "radially outward" or "radially outwardly", and the description "radially downward" or "radially downwardly" may also be described as "radially inward" or "radially inwardly". Similarly, use of the terms "horizontal" or "vertical" is for description purposes only with reference to the drawings, and is not meant to limit the potential orientations of various features when viewed in a universal frame of reference.

Figure 2:
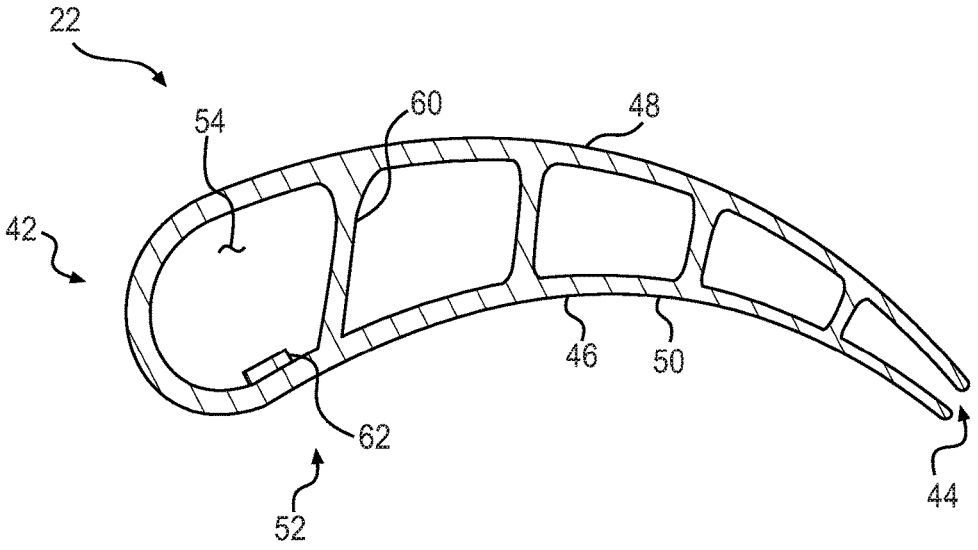
FIG. 2 is a horizontal sectional view of a turbine blade taken along lines 2-2 of FIG. 1.
Figure 3:
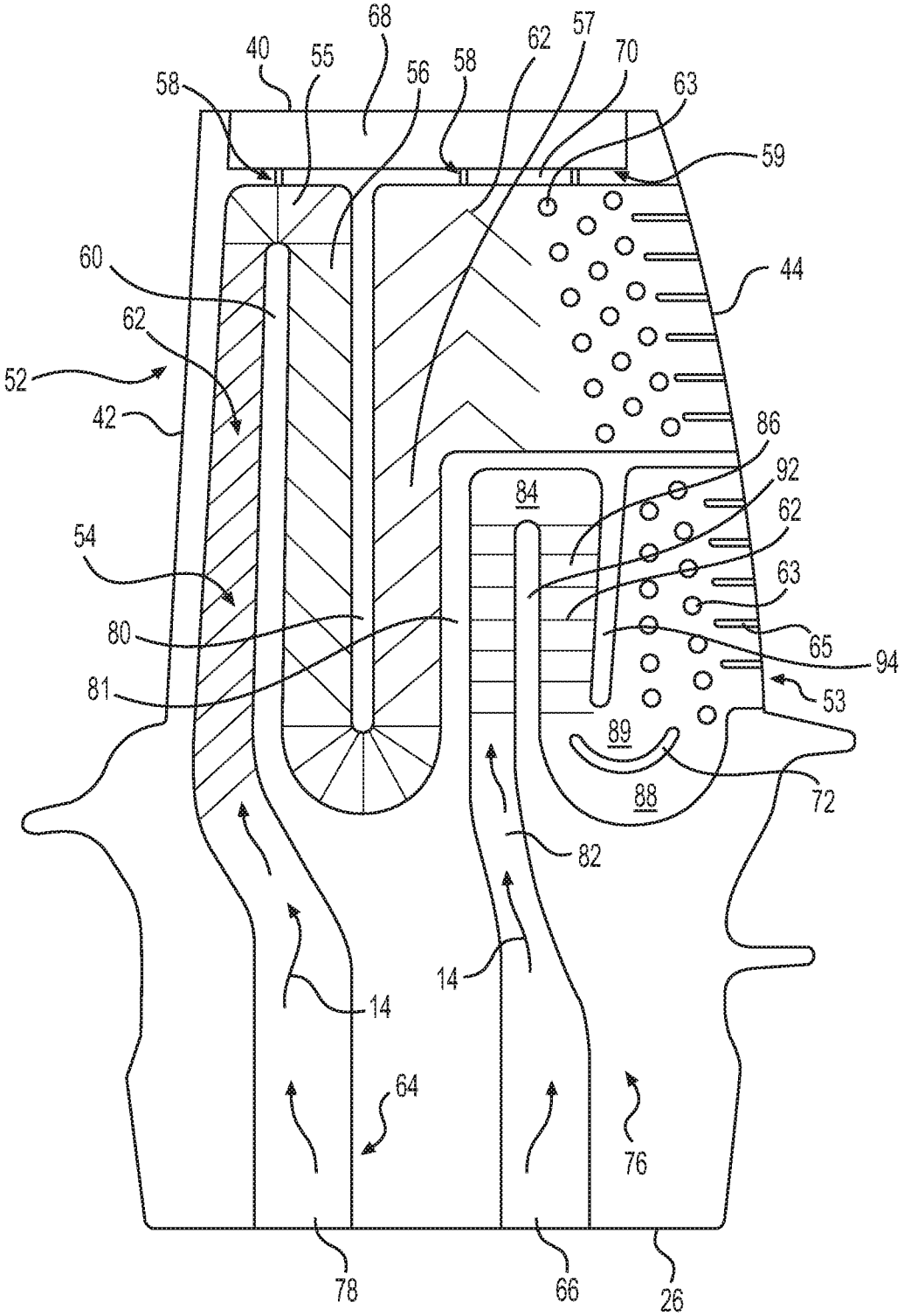
FIG. 3 is a vertical sectional view of one exemplary embodiment of the turbine blade of FIG. 2 taken along a section line extending from the leading edge to the trailing edge of the turbine blade interposed between the pressure side wall and the suction side wall of the turbine blade.
Figure 4:
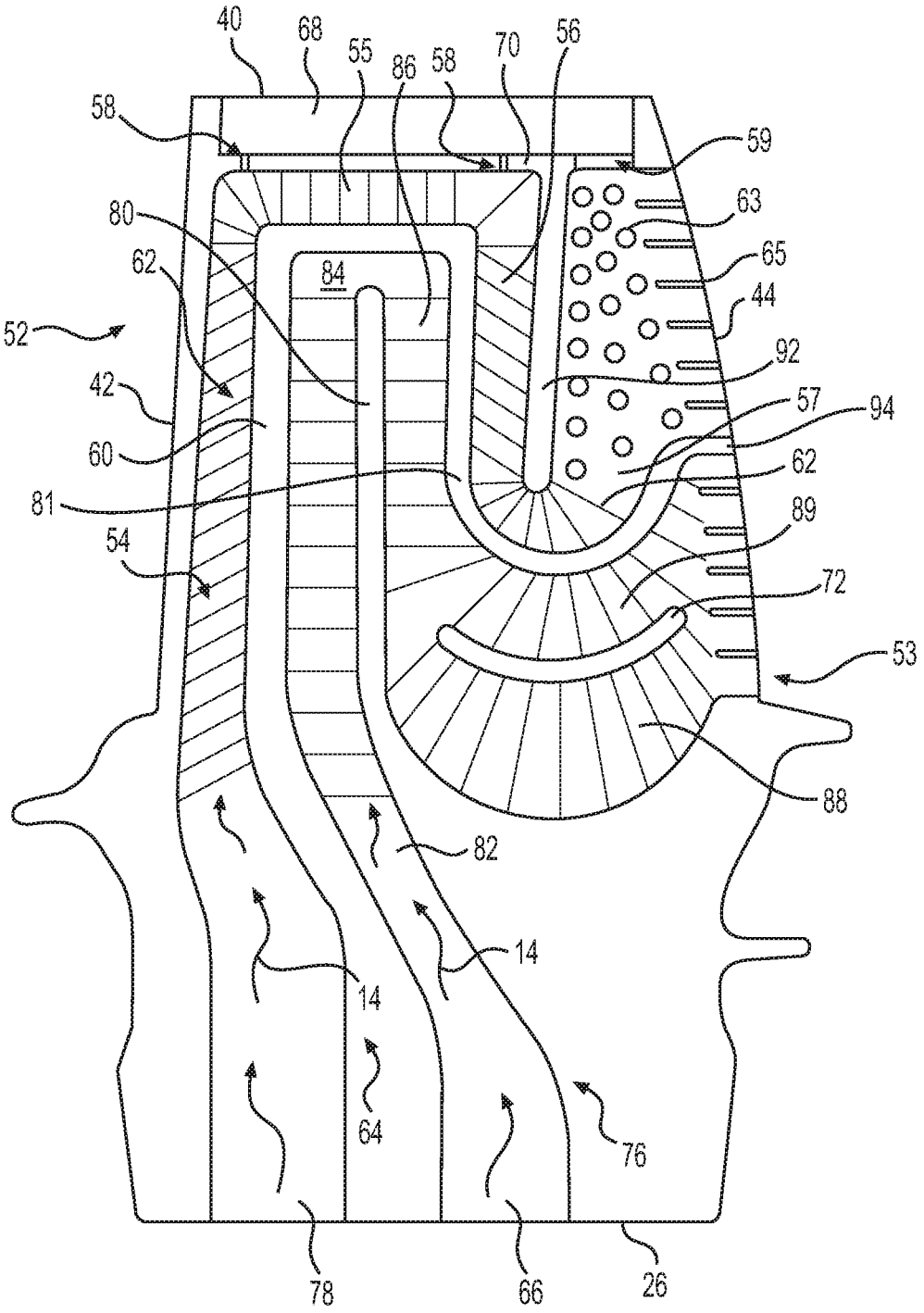
FIG. 4 is a vertical sectional view of another exemplary embodiment of the turbine blade of FIG. 2 taken along a section line extending from the leading edge to the trailing edge of the turbine blade interposed between the pressure side wall and the suction side wall of the turbine blade.

FIG. 2 shows an enlarged sectional view of a turbine blade 22 taken along lines 2-2 of FIG. 1. Each of the plurality of turbine blades 22 includes a leading edge 42, and a trailing edge 44 positioned opposite the leading edge 42 (FIGS. 2-4). A pressure, or concave side 46 and a suction, or convex side 48 are interposed between the leading edge 42 and the trailing edge 44 of the turbine blade 22. Each of the plurality of turbine blades 22 may have a generally hollow configuration formed by a peripheral wall 50, which, in some embodiments, may have a substantially uniform thickness.

As shown in FIGS. 2-4, an arrangement 52 for internally cooling each of the turbine blades 22 is provided. The arrangement 52 for internal cooling may include a pair of cooling paths 64 and 76 (FIGS. 3-4), positioned within the peripheral wall 50, and separated from one another. Fresh cooling fluid 14 may be supplied from the cooling fluid inlet opening 34 formed at the first, root end 26 of each of the turbine blades 22 through inlet openings 78, 66 into each of the separate cooling paths 64, 76, respectively. In this manner, each of the separate cooling paths may be supplied with fresh cooling fluid 14. The cooling paths 64 and 76 may have a rectangular cross-sectional shape through which cooling fluid 14 can flow. In other embodiments, however, the cross-sectional shape of the cooling paths 64 and 76 may be, for example, circular or oval. Any number of cooling paths could be used. The cooling paths may be configured to form wrapped, serpentine-shaped internal cooling paths, with portions of at least one of the cooling paths overlapping portions of another one of the cooling paths. The wrapped arrangement of at least two separate cooling paths, each supplied with fresh cooling fluid from the cooling fluid inlet opening 34, may further enhance the heat transfer efficiency of the internal cooling arrangement. The cooling paths 64 and 76 may be formed as passages defined at least in part by a plurality of internal walls, for example first, second, third, fourth, and fifth internal walls 60, 80, 81, 92, and 94, respectively, as described in more detail below (FIGS. 3-4). As shown in FIG. 2, each of the internal walls may be connected to, and in some instances formed integrally with, the peripheral wall 50 at both the pressure side 46 and the suction side 48 of the turbine blade 22.

The tips of the turbine blades 22 may experience large thermal loads due to hot gases flowing through the gap between each blade tip and the shroud 20. The flow accelerates due to the pressure difference between the pressure and suction sides, causing thin boundary layers and high heat transfer rates. The flow across the blade tips can be reduced by forming a recess 68 in the tip of each blade (sometimes referred to as a "squealer tip" geometry). An additional horizontal partition 70 formed at the tip end of the blade may separate the internal passages of the cooling paths from the horizontal recess 68 formed along the tip end of the blade 22. The horizontal partition 70 may be connected to the peripheral wall 50 at both the pressure side 46 and the suction side 48, and may include tip discharge holes 58 and tip discharge slots 59 therethrough that direct some of the cooling fluid from the first cooling path 64 into the horizontal recess 68 along the tip of the blade.

In an exemplary embodiment illustrated in FIG. 3, the first and second internal cooling paths 64 and 76 positioned within the peripheral wall 50 may be interposed between the leading edge 42 and the trailing edge 44 of each of the blades 22. The first cooling path 64 may include a first passage 54 extending radially upwardly along the leading edge 42 between the first, root end 26 and the second, tip end 40 of the turbine blade 22. The first passage 54 may be defined between the leading edge outer peripheral wall and the first internal wall 60.

As shown in FIG. 3, the first cooling path 64 may be configured in a serpentine shape, including the first passage 54 extending substantially parallel to the leading edge 42 from the first, root end 26 of the turbine blade 22 radially upwardly to the second, tip end 40 of the turbine blade 22. A substantially horizontal bend passage 55 disposed near the second, tip end 40 of the turbine blade 22 may connect the first passage 54 across the top of the first vertically oriented internal wall 60 to a second passage 56. The second passage 56 may be defined at least in part between the first internal wall 60 and the second internal wall 80, and may extend radially at least part way back down from the second, tip end 40 of the turbine blade 22 toward the first, root end 26, substantially parallel to the first passage 54. The bottom end of the second passage 56 may then connect across the bottom of the second internal wall 80 through another horizontal bend passage to an exit passage 57. The exit passage 57 may be defined at least in part between the second internal wall 80 and the third internal wall 81. The exit passage 57 may lead back upward toward the second, tip end 40 of the turbine blade to connect with an upper span region of the trailing edge 44 of the turbine blade 22. The second passage 56 and exit passage 57 may together form a substantially U-shaped passage extending radially downwardly from the tip end of the blade into a mid-chord, mid-span region of the blade. The first cooling path 64 may include a plurality of turbulators or flow disruptors in the form of pins 63 and fins 65 arranged along the upper span of the trailing edge 44. The first and second internal cooling paths 64, 76 may include additional turbulators or flow disruptors, such as trip-strips 62 and/or vanes 72 positioned at various spacings, positions, orientations, and locations along the passages to improve heat transfer by introducing swirling and turbulence into the flow of cooling fluid. As shown in the exemplary embodiment of FIG. 3, the trip-strips 62 arranged along the leading edge passage 54 may be arranged more closely together than the trip-strips 62 arranged along the downstream passages such as the second passage 56 and the exit passage 57. The closer spacing of the trip-strips 62 along the leading edge passage 54 may enhance the heat transfer efficiency at the portions of the internal cooling path where the blade is exposed to the greatest amount of heat.

The second internal cooling path 76 may also be configured in a serpentine shape, at least partially overlapping with one or more passages of the first cooling path 64. In the exemplary embodiment shown in FIG. 3, the second internal cooling path 76 may include a passage 82 defined at least in part between the third internal wall 81 and the fourth internal wall 92. The passage 82 may be configured to direct fresh cooling fluid from the cooling fluid inlet opening 34 at the first, root end 26 of the turbine blade 22 to the lower span 53 of the trailing edge 44 of the turbine blade 22. The passage 82 may connect to a substantially horizontal bend passage 84 formed across the top end of the fourth internal wall 92 and to another passage 86 that leads radially downwardly toward the first, root end 26 of the turbine blade. The bottom end of the passage 86 may connect to a substantially horizontal bend passage across the bottom of the fifth internal wall 94 to the lower span 53 of the trailing edge 44. The substantially horizontal bend passage at the bottom end of passage 86 may be bifurcated by a curved internal vane 72, which may split the horizontal connection into an upper passage 89 and a lower passage 88. The vane 72 may assist in redirecting cooling fluid that is flowing radially downwardly in passage 86 to an upward and rearward direction to exit the blade 22 along the lower span 53 of the trailing edge 44. The second internal cooling path 76 may include a plurality of turbulators or flow disruptors in the form of pins 63 and fins 65 arranged along the lower span 53 of the trailing edge 44.

Additional turbulators or flow disruptors in the form of trip-strips 62 may be arranged in various configurations, orientations, and densities of spacing within the passages of both the first and second internal cooling paths 64, 76. The trip-strips 62 may be disposed along the inner surface of the peripheral wall 50 in each of the passages, and may be configured to produce a turbulent fluid flow within the passages for improved heat transfer. In some embodiments, the trip-strips 62 may be formed integrally with the peripheral wall 50. The trip-strips 62 may have any cross-section, length, or orientation within each passage depending on the internal dimensions of the passages and the desired amount of turbulence to be created in the cooling fluid flow through the passages. In some embodiments, the trip-strips 62 may be a plurality of broken ribs arranged on the peripheral wall 50 at different angles within the passages. In other embodiments, the trip-strips 62 may take the form of one or more concave cavities, or dimples in the peripheral wall 50 and/or one or more convex protrusions formed on the peripheral wall 50.

The top ends of passages 54, 56, and 57, and/or the substantially horizontal bend passage 55 connecting the top end of first passage 54 across the top of the first internal wall 60 to the top end of second passage 56 may be connected by one or more tip discharge holes 58 to the horizontal recess 68 extending along the tip end of the turbine blade 22. The upper span of trailing edge 44 may also be connected by one or more tip discharge slots 59 to the horizontal recess 68. The tip discharge holes 58 and tip discharge slots 59 allow some of the cooling fluid 14 passing through the first internal cooling path 64 to cool the tip end 40 of the turbine blade 22.

The lower span 53 of the trailing edge 44 of the turbine blade 22 tends to be hotter than the upper span of the trailing edge. The second internal cooling path 76 may therefore be configured to provide fresh cooling fluid directly to the lower span region 53 of the trailing edge 44. In contrast, the cooling fluid in the first internal cooling path 64 reaches the upper span of the trailing edge 44 only after having passed along the leading edge 42, the tip end of the blade, and the mid-chord span of the blade. Although the exemplary embodiment of FIG. 3 includes the first internal cooling path 64 and the second internal cooling path 76 each having essentially three radially oriented passes, one of ordinary skill in the art will recognize that the number of passes in each of the cooling paths may be different. Additionally, the amount of overlap of the two or more wrapped serpentine paths may be designed to achieve a desired amount of heat transfer from each of different regions on the blade with the least amount of cooling fluid required.

In the alternative embodiment illustrated in FIG. 4, the cooler, mid-chord, mid-span region of the turbine blade 22 may be cooled by cooling fluid passing through a serpentine-shaped passage in the second internal cooling path 76 before being directed to the lower span 53 of the trailing edge 44. The first internal cooling path 64 may also be configured in a serpentine shape, at least partially wrapping around the portion of the second internal cooling path directed through the mid-chord, mid-span region of the turbine blade 22. The first internal cooling path 64 may include the first passage 54 extending substantially parallel to the leading edge 42 from the first, root end 26 of the turbine blade 22 radially upwardly to the second, tip end 40 of the turbine blade 22. A substantially horizontal bend passage 55 disposed near the second, tip end 40 of the turbine blade 22 may connect the first passage 54 across the top of the first, second, and third internal walls 60, 80, and 81 to a second radially oriented passage 56. In this manner, the freshest cooling fluid flowing in the first internal cooling path 64 of the embodiment shown in FIG. 4 is supplied along the leading edge 42 and along the tip end 40 of the blade 22. The second passage 56 of the first internal cooling path 64 may be defined at least in part between the third internal wall 81 and the fourth internal wall 92, and may extend radially at least part way back down from the second, tip end 40 of the turbine blade 22 toward the first, root end 26, substantially parallel to the first passage 54. The first passage 54, substantially horizontal bend passage 55, and second passage 56 may at least partially overlap and wrap around portions of passage 82, horizontal bend passage 84, and passage 86 of the second internal cooling path 76, as shown in FIG. 4. The bottom end of the second passage 56 may then connect across the bottom of the fourth internal wall 92 through another horizontal bend passage to an exit passage 57. The exit passage 57 may be defined at least in part between the fourth internal wall 92 and the fifth internal wall 94. The exit passage 57 in the embodiment shown in FIG. 4 may lead back upward toward the second, tip end 40 of the turbine blade 22 to connect with an upper span region of the trailing edge 44 of the turbine blade. The first cooling path 64 may include a plurality of turbulators or flow disruptors in the form of pins 63 and fins 65, for example, arranged along the upper span of the trailing edge 44. The first and second internal cooling paths 64, 76 may include additional turbulators or flow disruptors, such as trip-strips and/or vanes positioned at various spacings, orientations, and locations along the passages to improve heat transfer by introducing swirling and turbulence into the flow of cooling fluid.

The second internal cooling path 76 may also be configured in a serpentine shape, at least partially overlapping with one or more passages of the first cooling path 64. In the exemplary embodiment shown in FIG. 4, the second internal cooling path 76 may include the passages 82, 84, and 86 defined at least in part between the first, second, and third internal walls 60, 80, and 81. The passages 82, 84, and 86 may direct cooling fluid in the second internal cooling path 76 to the mid-chord, mid-span region of the turbine blade 22 before the cooling fluid exits the turbine blade through the lower span region 53 of the trailing edge 44. The passage 86 may connect at its lower end to a horizontal bend passage passing beneath the fifth internal wall 94 to the lower span region 53 of the trailing edge. A vane 72 may be provided in the horizontal bend passage and configured to split the passage leading to the lower span region 53 into an upper passage 89 and a lower passage 88. In the embodiment illustrated in FIG. 4, some heat transfer will occur from the mid-chord, mid-span region of the turbine blade to the cooling fluid passing through the second internal cooling path 76. However, since the mid-chord, mid-span region of the turbine blade generally is cooler than the leading edge, or the lower span of the trailing edge, the cooling fluid that reaches the lower span of the trailing edge in the second internal cooling path will still be cool enough to achieve a desired amount of heat transfer and cooling along the lower span region 53 of the trailing edge 44.

As with the embodiment illustrated in FIG. 3, the alternative embodiment of FIG. 4 may include additional turbulators or flow disruptors in the form of trip-strips 62 arranged in various configurations, orientations, and densities of spacing within the passages of both the first and second internal cooling paths 64, 76. The trip-strips 62 may be disposed along the inner surface of the peripheral wall 50 in each of the passages, and may be configured to produce a turbulent fluid flow within the passages for improved heat transfer. In some embodiments, the trip-strips 62 may be formed integrally with the peripheral wall 50. The trip-strips 62 may have any cross-section, length, or orientation within each passage depending on a desired amount of turbulence to be created in the cooling fluid flow. In some embodiments, the trip-strips 62 may be a plurality of broken ribs arranged on the peripheral wall 50 at different angles within the passages. As shown in FIG. 3, the trip-strips 62 may also be configured to redirect the cooling fluid flow moving in an upwardly direction from exit passage 57 to a horizontal, rearward direction toward the upper span of the trailing edge. In other embodiments, the trip-strips 62 may take the form of one or more concave cavities, or dimples in the peripheral wall 50 and/or one or more convex protrusions formed on the peripheral wall 50.

The substantially horizontal bend passage 55 connecting the top end of first passage 54 across the top of the first, second, and third internal walls 60, 80, and 81 to the top end of second passage 56 may be fluidly connected through the tip discharge holes 58 in the horizontal partition 70 to the horizontal recess 68 extending along the tip end of the turbine blade 22. The upper span of trailing edge 44 may also be connected by one or more tip discharge slots 59 through the horizontal partition 70 to the tip end horizontal recess 68. The tip discharge holes 58 and tip discharge slots 59 allow some of the cooling fluid 14 passing through the first internal cooling path 64 to cool the tip end 40 of the turbine blade 22.

The lower span region 53 of the trailing edge 44 tends to be hotter than the upper span of the trailing edge. The second internal cooling path 76 may therefore be configured to provide cooling fluid that has only passed through the cooler mid-chord, mid-span region of the turbine blade before reaching the lower span region 53 of the trailing edge 44. In contrast, the cooling fluid in the first internal cooling path 64 reaches the upper span of the trailing edge 44 only after having passed along the relatively hotter portions along the leading edge 42 and the tip end 40 of the blade 22.

As shown in the exemplary embodiments of FIGS. 3 and 4, the first internal cooling path 64 may be formed as a 3-pass serpentine cooling passage wherein the cooling fluid flowing through the cooling path changes flow direction from radially outwardly between the root end and the tip end of the blade, to radially inwardly between the tip end and the root end, and back to radially outwardly and rearwardly to the upper span of the trailing edge. The second internal cooling path 76 may also be formed as a 3-pass serpentine cooling passage with cooling fluid flowing radially outwardly, radially inwardly, and radially outwardly and rearwardly to the lower span of the trailing edge. Moreover, at least a portion of the first internal cooling path 64 may overlap or wrap around at least a portion of the second internal cooling path 76. The number of passes in each cooling path and the total number of cooling paths may be varied. Various parameters of the cooling paths, such as the cross-sectional areas of each passage, the configuration and quantity of flow disruptors positioned within each passage, the portions of the blade through which the paths are directed, and the relative overlap between the two or more internal cooling paths may be selected in order to maximize the efficiency of heat transfer from the various portions of the blades while minimizing the amount of cooling fluid needed to keep all portions of the blade within desired ranges of temperatures. The aforementioned description is of the first stage turbine assembly 12. However, it should be understood that the construction could be typical of the remainder of the turbine stages within the turbine section 10 where cooling may be employed.

INDUSTRIAL APPLICABILITY

The above-mentioned apparatus, while being described as an apparatus for cooling a turbine blade, can be applied to any other blade or airfoil requiring temperature regulation. For example, turbine nozzles in a GTE could incorporate the cooling apparatus described above. Moreover, the disclosed cooling apparatus is not limited to GTE industry application. The above-described principal, that is, using wrapped, serpentine internal cooling paths that ensure the freshest cooling fluid will reach the hottest portions of the turbine blade may be applied to other applications and industries requiring temperature regulation of a working component.

The following operation may be directed to the first stage turbine assembly 12. However, the cooling operation of other airfoils and stages (turbine blades or nozzles) could be similar. Each turbine blade may include at least two wrapped serpentine internal cooling paths defined at least in part between internal walls that extend between a pressure side and a suction side of the blade. The pressure side and suction side of the blade are interposed between a leading edge and a trailing edge of the blade and between a root end and a tip end of the blade. The cooling method in accordance with various implementations of this disclosure may include supplying fresh cooling fluid through a first passage of a first one of the internal cooling paths, wherein the first passage extends radially from the root end to the tip end adjacent the leading edge of the blade. Spent cooling fluid from the first passage adjacent the leading edge may then be directed to one of an upper span of the trailing edge of the blade or a mid-chord passage and the upper span of the trailing edge of the blade. Fresh cooling fluid may be provided through a second one of the internal cooling paths to one of a lower span of the trailing edge of the blade or a mid-chord passage and the lower span of the trailing edge.

A portion of the compressed fluid from the compressor section of the GTE may be bled from the compressor section and forms the cooling fluid 14 used to cool the first stage turbine blades 22. The compressed fluid exits the compressor section, flows through an internal passage of a combustor discharge plenum, and enters into a portion of the fluid flow channel 16 as cooling fluid 14. The flow of cooling fluid 14 is used to cool and prevent ingestion of hot gases into the internal components of the GTE. For example, the air bled from the compressor section flows into a compressor discharge plenum, through spaces between a plurality of combustion chambers, and into the fluid flow channel 16 (FIG. 1). After passing through the fluid flow channel 16, the cooling fluid enters the cooling fluid inlet opening 34 between the first, root end 26 of the turbine blade 22 and the bottom 32 of the root retention slot 30 in the disc 24. The cooling fluid inlet opening 34 may be fluidly connected to the first and second cooling paths 64 and 76, respectively, in the interior of the turbine blade 22 (FIGS. 3 and 4).

As shown in the exemplary embodiment of FIG. 3, a first portion of the cooling fluid 14, after having passed through the cooling fluid inlet opening 34 (FIG. 1), may enter the first cooling path 64. The cooling fluid 14 enters the first cooling path inlet opening 78 from the cooling fluid inlet opening 34, and travels in a first pass radially upwardly along the first passage 54, absorbing heat from the peripheral wall 50 along the leading edge 42 and from the first internal wall 60. The cooling fluid flows around the top of the first internal wall 60 in the horizontal bend passage 55 and then in a second pass back in a radially downward direction through passage 56. Finally, in a third pass the cooling fluid 14 flows through another horizontal bend passage around the bottom of the second internal wall 80 and radially upwardly through the exit passage 57 before exiting the turbine blade 22 across a plurality of flow disruptors along the upper span of the trailing edge 44.

A second portion of the cooling fluid 14, after having passed through the cooling fluid inlet opening 34 (FIG. 1), may enter the second cooling path 76 through inlet opening 66 (FIG. 3). The cooling fluid 14 in the second cooling path 76 travels radially upwardly along the passage 82, absorbing heat from the third internal wall 81 and the fourth internal wall 92 in the region of the lower span of the trailing edge. The cooling fluid enters the horizontal bend passage 84 around the top of the internal wall 92 and is redirected back radially downwardly along the passage 86. The cooling fluid 14 then flows through another horizontal bend passage around the bottom of the internal wall 94 before exiting the blade 22 across a plurality of flow disruptors along the lower span 53 of the trailing edge 44. As shown in FIG. 3, the cooling fluid exiting the passage 86 may be split into the upper passage 89 and the lower passage 88 above and below the vane 72, and redirected from a radially downward flow to a radially upward and rearward flow through the plurality of pins 63 and fins 65 spaced along the lower span 53 of the trailing edge 44. In the embodiment of FIG. 3, the entire length of the second cooling path 76 may be concentrated close to the lower span region 53 of the trailing edge portion of the blade 22. The first internal cooling path 64 may provide cooling for the leading edge, the mid-chord, mid-span region, the tip end, and the upper span of the trailing edge of the blade.

The alternative configuration of FIG. 4 directs the second portion of the cooling fluid 14 in the second cooling path 76 through the mid-chord, mid-span region of the blade first before the cooling fluid exits the blade along the lower span 53 of the trailing edge 44. The first cooling path 64 directs the cooling fluid along the leading edge 42 and the tip end of the blade before directing the cooling fluid through the flow disruptors along the upper span of the trailing edge. Therefore, the amount of heat transfer from the internal walls 60, 80, and 81 in the mid-chord, mid-span region of the blade into the second cooling path 76 is relatively low, and the cooling fluid exiting from the lower span region 53 of the trailing edge 44 is still cool enough to achieve the desired heat transfer from the lower span region of the trailing edge.

In some instances, the turbine blade 22 may be manufactured by a known casting process, for example investment casting. During investment casting, the blade 22 may be formed having a partially vacant internal area including the cooling paths 64 and 76 described above to allow for the flow of cooling fluid. Investment casting the turbine blade 22 may form the flow disruptors such as trip-strips 62, vane 72, pins 63, and fins 65 at the time of casting. Because the flow disruptors may be cast with the blade 22, they may be formed integral to the inner surface of the peripheral wall 50 of the turbine blade 22. In various embodiments and configurations, the flow disruptors may be formed integrally with the peripheral wall 50 on one or both of the pressure side 46 and the suction side 48 of the turbine blade 22. In some instances, the casting material for the blade 22, and therefore also for the various flow disruptors, may be metal. In some cases, the turbine blade may be cast as a single crystal, or monocrystalline solid, and may be made of a superalloy.

Typical arrangements for directing fluid through a turbine blade include passages extending through an interior of the blade. While the passages generally include one or more turns or corners through which the fluid is directed, these turns can cause undesired pressure losses. The turns and corners are susceptible to flow separation, that is, dead-zones or vacant space in a flow path without fluid flow. In addition to pressure losses, using larger passages for cooling can also result in flow separation from the increased cross sectional area of the passages. When the fluid flows at a high velocity through the passages, there is often insufficient time for flow expansion or diffusion, which results in flow separation, or chaos, within the turbine blade. When the flow of cooling fluid separates within the passages, the cooling fluid does not fill the space of the passages, and therefore the heat transfer coefficient may decrease. With a decrease in the heat transfer coefficient, there is a risk of overheating and problems related to premature wear of the turbine blades, which can prevent overall efficient operation of the GTE.

The above-described arrangement with wrapped, serpentine passages and separate cooling paths configured to provide the freshest cooling fluid to the hottest portions of the blade provides more efficient use of the cooling fluid bled from the compressor section of a GTE in order to facilitate increased component life while maintaining a desired efficiency of the GTE. Providing the flow disruptors such as densely spaced trip-strips 62 along the leading edge passage 54, and pins 63 and fins 65 along the lower span 53 of the trailing edge 44 as described can reduce the pressure drop and flow separation in the cooling paths, thereby increasing the heat transfer coefficient in the turns of the cooling paths and also downstream of the turns. Overlapping cooling passages with fresh cooling fluid in one cooling path and cooling passages with spent cooling fluid in another cooling path also allows for maximum efficiency of heat transfer with the least amount of cooling fluid. Increasing the heat transfer in this manner can result in more effective cooling of the turbine blade, which reduces the temperature of the metal of the blade, while at the same time requiring the least amount of cooling air from the compressor section of the GTE for improved overall efficiency. Reducing the blade temperature reduces stress imparted on the blade, which increases the blade service life. Increasing the blade service life allows the turbine blades to be used for longer periods, thus reducing the frequency of necessary turbine section inspections for a given GTE.

It will be apparent to those skilled in the art that various modifications and variations can be made to the disclosed turbine blade cooling system. Other embodiments will be apparent to those skilled in the art from consideration of the specification and practice of the disclosed system and method. It is intended that the specification and examples be considered as exemplary only, with a true scope being indicated by the following claims and their equivalents.

What is claimed is:

1. A turbine blade for a gas turbine engine, comprising:

at least two wrapped, serpentine-shaped internal cooling paths, wherein:

a first one of the serpentine-shaped internal cooling paths includes:

a first passage that extends radially along a leading edge of the turbine blade from adjacent a root end of the turbine blade to adjacent a tip end of the turbine blade, the first passage being configured to provide fresh cooling fluid to the leading edge; and a second passage downstream of the first passage, the second passage being configured to discharge spent cooling fluid from the first passage of the first one of the serpentine-shaped internal cooling paths across a plurality of flow disrupters positioned along an upper span of a trailing edge of the turbine blade before exiting from the trailing edge of the turbine blade; and a second one of the serpentine-shaped internal cooling paths being configured to supply fresh cooling fluid to a lower span of the trailing edge of the turbine blade.

2. The turbine blade of claim 1, further including the first one of the serpentine-shaped internal cooling paths including an intermediate U-shaped passage interposed between the first passage and the second passage and extending into a mid-chord, mid-span region of the turbine blade.

3. The turbine blade of claim 1, wherein the first, serpentine-shaped internal cooling path is a 3-pass cooling path.

4. The turbine blade of claim 1, wherein the second, serpentine-shaped internal cooling path is a 3-pass cooling path.

5. The turbine blade of claim 1, wherein the second one of the serpentine-shaped internal cooling paths includes a U-shaped passage leading to the lower span of the trailing edge, and wherein the U-shaped passage is overlapped at least in part by a portion of the first serpentine-shaped internal cooling path.

6. The turbine blade of claim 5, wherein the overlapping portion of the first serpentine-shaped internal cooling path is an intermediate U-shaped passage interposed between the first passage and the second passage of the first serpentine-shaped internal cooling path and extending into a mid-chord, mid-span region of the turbine blade.

7. The turbine blade of claim 1, wherein the plurality of flow disruptors positioned along the upper span of the trailing edge of the blade include a plurality of pins and fins.

8. The turbine blade of claim 1, wherein the plurality of flow disruptors positioned along the upper span of the trailing edge of the blade include a plurality of trip-strips.

9. The turbine blade of claim 1, wherein the first passage of the first serpentine-shaped internal cooling path includes a plurality of trip-strips spaced closer together along the first passage than a plurality of trip-strips spaced along the second passage.

10. A method of cooling a turbine blade for a gas turbine engine, wherein the turbine blade includes at least two wrapped serpentine-shaped internal cooling paths defined at least in part between internal walls that extend between a pressure side and a suction side of the blade, and wherein the pressure side and suction side of the blade are interposed between a leading edge and a trailing edge of the blade and between a root end and a tip end of the blade, the method comprising:

supplying fresh cooling fluid through a first passage of a first one of the internal cooling paths, wherein the first passage extends radially from the root end to the tip end and adjacent the leading edge of the blade;

directing spent cooling fluid from the first passage adjacent the leading edge to one of an upper span of the trailing edge of the blade or a mid-chord passage and the upper span of the trailing edge of the blade; and supplying fresh cooling fluid through a second one of the internal cooling paths to one of a lower span of the trailing edge of the blade or a mid-chord passage and the lower span of the trailing edge.

11. The method of claim 10, wherein spent cooling fluid from the first passage of the first one of the serpentine-shaped internal cooling paths is directed into an intermediate U-shaped passage interposed between the first passage and the trailing edge of the blade and extending into a mid-chord, mid-span region of the turbine blade.

12. The method of claim 10, wherein the cooling fluid flows through the first, serpentine-shaped internal cooling path in 3 passes including a first pass in a radially upwardly direction, a second pass in a radially downwardly direction, and a third pass in a radially upwardly direction before passing out of the blade in an upper span trailing edge region of the blade.

13. The method of claim 10, wherein the cooling fluid flows through the second, serpentine-shaped internal cooling path in 3 passes including a first pass in a radially upwardly direction, a second pass in a radially downwardly direction, and a third pass in a radially upwardly direction before passing out of the blade in a lower span trailing edge region of the blade.

14. The method of claim 10, wherein the second one of the serpentine-shaped internal cooling paths includes a U-shaped passage leading to the lower span of the trailing edge, and wherein the U-shaped passage is overlapped at least in part by a portion of the first serpentine-shaped internal cooling path.

15. The method of claim 14, wherein the overlapping portion of the first serpentine-shaped internal cooling path is an intermediate U-shaped passage interposed between the first passage and the second passage of the first serpentine-shaped internal cooling path and extending into a mid-chord, mid-span region of the turbine blade.

16. A turbine blade for a gas turbine engine, comprising:

at least two wrapped, serpentine internal cooling paths, wherein:

a first one of the serpentine internal cooling paths includes:

a first passage configured to extend along a leading edge of the turbine blade and provide fresh cooling fluid to the leading edge; and a second passage downstream of the first passage, the second passage configured to discharge spent cooling fluid from the first passage across a plurality of pins and fins positioned along an upper span of a trailing edge of the turbine blade; and a second one of the serpentine internal cooling paths being configured to supply fresh cooling fluid to a mid-chord passage through the turbine blade, wherein the mid-chord passage is overlapped on a leading edge side and on a trailing edge side by the first passage and the second passage, respectively, of the first one of the serpentine internal cooling paths, and wherein the second one of the serpentine internal cooling paths is configured to supply cooling fluid that has flowed through the mid-chord passage of the turbine blade to a lower span of the trailing edge of the turbine blade.

17. The turbine blade of claim 16, wherein the second one of the serpentine internal cooling paths is a 3-pass cooling path including first, second, and third passages configured for directing cooling fluid radially upwardly, radially downwardly, and radially upwardly, respectively, and wherein the mid-chord passage of the second one of the serpentine internal cooling paths includes a U-shaped passage at least partially interposed between the first passage and the second passage of the first one of the serpentine internal cooling paths.

18. The turbine blade of claim 16, wherein the first one of the serpentine internal cooling paths is a 3-pass cooling path including first, second, and third passages configured for directing cooling fluid radially upwardly, radially downwardly, and radially upwardly, respectively.

19. The turbine blade of claim 16, further including a plurality of flow disruptors positioned along the first passage and the second passage of the first one of the serpentine internal cooling paths, wherein the flow disruptors include a plurality of trip-strips that are spaced more closely together in the first passage than in the second passage.

20. The turbine blade of claim 16, wherein the second one of the serpentine internal cooling paths includes an internal vane positioned downstream of the mid-chord passage and configured to bifurcate the flow of cooling fluid to the lower span of the trailing edge of the turbine blade.

* * * * *